US006976709B1

(12) United States Patent
Yuen

(10) Patent No.: US 6,976,709 B1
(45) Date of Patent: Dec. 20, 2005

(54) POSTAL MAILER WITH CALLING CARD

(76) Inventor: Po W. Yuen, 13 Stonehouse Rd., Scarsdale, NY (US) 10583

( * ) Notice: Subject to any disclaimer, the term of this patent is extended or adjusted under 35 U.S.C. 154(b) by 64 days.

(21) Appl. No.: 10/715,853

(22) Filed: Nov. 19, 2003

(51) Int. Cl.[7] ..... B42D 3/00

(52) U.S. Cl. ..... 283/103; 283/2; 283/46; 283/51; 283/56; 283/117; 229/92.8; 229/92; 40/124.11; 40/124.12

(58) Field of Search ..... 283/2, 46, 51, 283/56, 117, 103; 229/92, 92.8; 40/124.11, 40/124.12

(56) References Cited

U.S. PATENT DOCUMENTS

| | | | | |
|---|---|---|---|---|
| 88,722 | A | 4/1869 | Klaucke et al. | |
| 1,957,374 | A * | 5/1934 | Unger | 283/116 |
| 2,159,486 | A * | 5/1939 | Mayer | 229/92.8 |
| 4,272,327 | A | 6/1981 | Logan | |
| 5,029,902 | A | 7/1991 | Komori | |
| 5,299,835 | A | 4/1994 | Sonnenberg | |
| 5,468,021 | A * | 11/1995 | Ovadia | 283/56 |
| 5,833,129 | A * | 11/1998 | Smith | 229/92.8 |
| 6,203,070 | B1 * | 3/2001 | Richardson | 283/117 |
| 6,269,158 | B1 * | 7/2001 | Kim | 379/144.01 |
| 6,305,716 | B1 * | 10/2001 | Warther et al. | 283/61 |
| 6,520,542 | B2 * | 2/2003 | Thompson et al. | 283/51 |
| 6,572,149 | B2 * | 6/2003 | Long | 283/51 |
| 6,623,039 | B2 * | 9/2003 | Thompson et al. | 283/61 |
| 2003/0006604 | A1 * | 1/2003 | Bennett | 283/46 |

* cited by examiner

*Primary Examiner*—Boyer Ashley
*Assistant Examiner*—Mark Henderson
(74) *Attorney, Agent, or Firm*—Shlesinger, Arkwright & Garvey LLP

(57) ABSTRACT

A postal mailer which comprises a postcard having in the front left top section a detachable calling card and having in the back surface left top, left bottom, right bottom and central sections map indicia designating the general area and specific location of the return address indicia on the postcard.

6 Claims, 2 Drawing Sheets

POSTAL MAILER WITH CALLING CARD

FILED OF THE INVENTION

This invention relates to a postal mailer having a detachable calling card in the position of the normal return address of a postcard.

BACKGROUND OF THE INVENTION

Mailing devices with a tear-off are shown in the early patent of Klaucke et al. 88,732 patented Apr. 6, 1862. The tear-off in this instance has glue applied to the back for placing the sender address on a separate envelope making it the return address.

U.S. patent application publication U.S. 2003/0006604 A1 of Jan. 9, 2003 discloses a travel publication in which a tear-off provides a customer information with regard to a specific place and its location is shown on a map of the reverse side. The information is normally supplied by a travel agency to a customer to allow the customer to know where a specific location is that he might be interested in and the tear-off is in the right hand upper portion of the travel publication. Long U.S. Pat. No. 6,572,149 B2 provides a folder with removable perforated coupons and the folder includes a locator map showing where the proprietor of the coupon is located.

Sonnenberg U.S. Pat. No. 5,299,835 shows a promotional note page which includes a second portion which is a tear-off business card.

Logan U.S. Pat. No. 4,272,327 shows the idea of providing a address label which can be applied to a letter which when inserted into a window envelope can be seen as a mailing address.

OBJECTS AND SUMMARY OF THE INVENTION

It is an object of this invention to provide a postal mailer in the form of a postcard which has a detachable calling card which serves as the return address for the post card prior to its being removed once the card has been received so that the recipient of the postcard will have available the address of the sender in the form of a business card which he can carry with him.

It is another object of this invention to provide a postal mailer which includes a map of the reversed side as to the exact location of the sender.

Yet another object of this invention is to provide a tear-off calling card attached to a postcard which provides information on both sides of the calling card in bilingual format.

A further object of this invention is to provide a calling card which can be removed from a postal mailer which also provides communication information such as telephone number and fax information.

Yet another object of this invention is to provide a postal mailer in the form of a postcard which provides map information indicia which does not interfere with printing of the calling card.

Yet another object of this invention is to provide a postal mailer which includes a detachable calling card and a map showing the location of the sender in detail and in a color different from the remainder of the map printed information for quick review.

Yet a further object of this invention is to provide a postal mailer calling card which is detachable and which includes a map on the main portion of the mailer which does not interfere with the sender's address and which provides information to the recipient as to the location of the nearest railway, subway or bus terminals and stops.

A further object of this invention is to provide a unique postal mailer which is inexpensive and easily manufactured.

These and other objects of the invention will be apparent from the following description and claims including the drawings which are described as follows:

DETAILED DESCRIPTION OF THE DRAWINGS

FIGS. 1 AND 2

Figure 1:
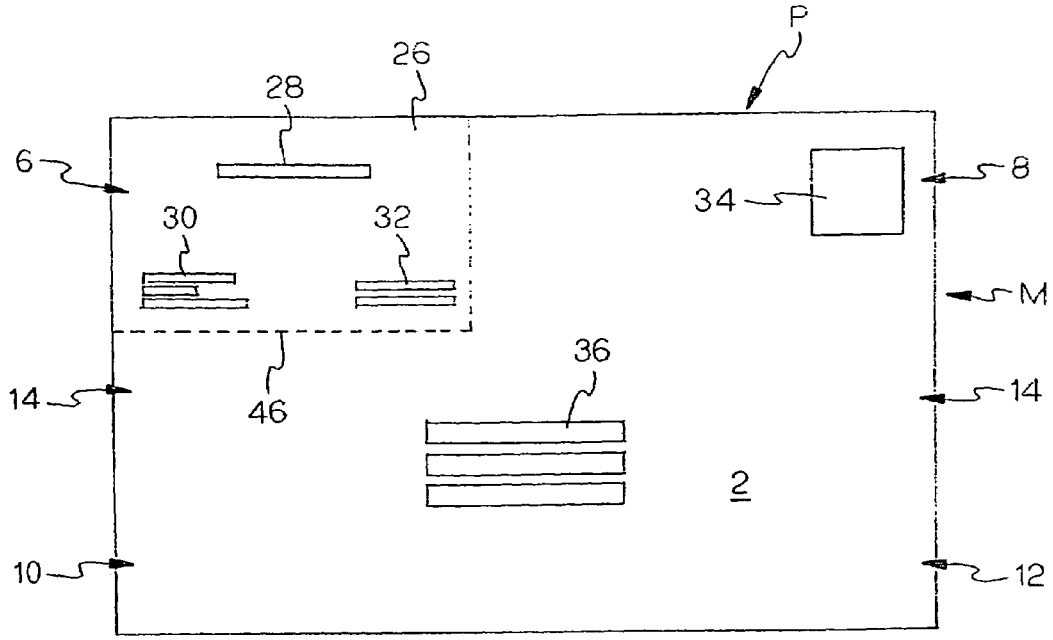
FIG. 1 is a top plan view of the postal mailer showing the perforation line of the tear-off.
Figure 2:
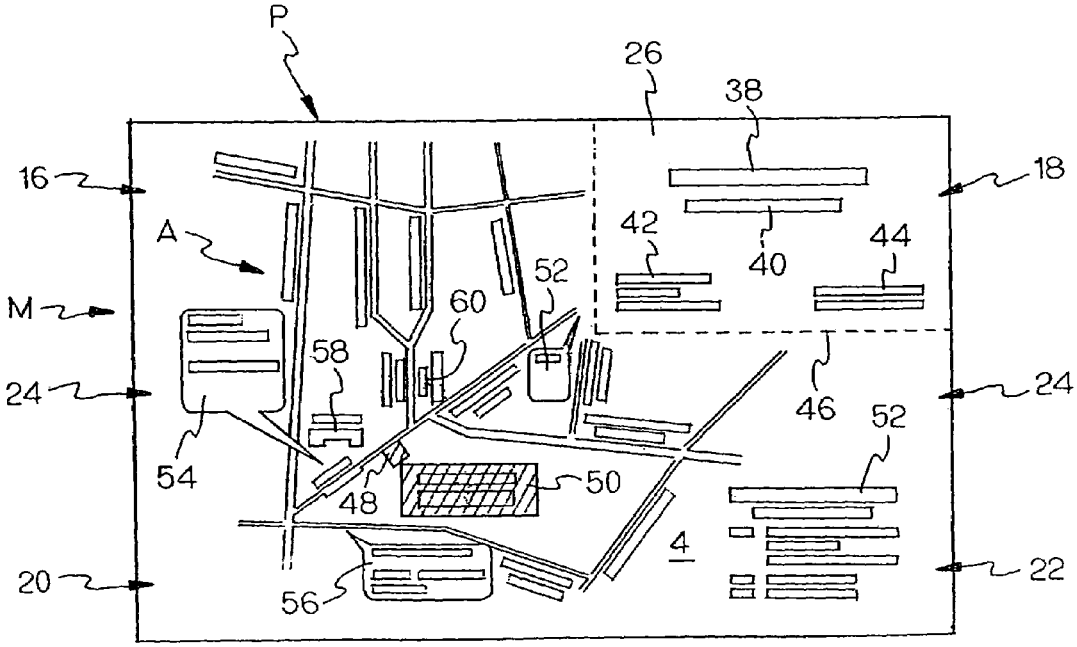
FIG. 2 is a bottom plan view of the obverse side of the of the mailer shown in FIG. 1.

In FIG. 1, the mailer M is in the form of a postcard P having a front surface 2 and a back surface 4 (FIG. 2). The front surface 2 has a left top section 6, and right top section 8, a left bottom section 10, a right bottom section 12 and a central section 14. The back surface 4 has a left top section 16, a right top section 18, and left bottom section 20, a right bottom section 22, and a central section 24.

The right top section 6 of the surface 2 has a detachable calling card 26 having addressor indicia 28, address indicia 30, and communication indicia 32 such as telephone number, fax number, email and website information. The right top section 8 is provided with an area which may be designated specifically with indicia 34 indicating placement of postage. The left bottom, right bottom and central sections are available for placement of addressee indicia 36.

The back surface 4 of the postcard P shows the back of the detachable calling card 26 which includes the address or indicia 38 in a first language and address indicia 40 in a second language making the card bilingual. The back of the card 26 includes address indicia 42 of the addressor. Communication indica 44 is provided in a manner similar to that shown on the front of the detachable calling card 26 and may include second language indicia. In FIGS. 1 and 2, the detachable calling card 26 is removed from mailer M by separation along the perforated line 46.

The back surface 4 of the postcard P is provided with a map A. The map discloses the street information about the addressor's specific location 48 which includes a block diagram 50 having the addressor's name which may be in more than one language adjacent the addressor's specific location 48. The specific location 48 and the block diagram 50 are of a different color from the street indicia of the map A. The map A includes transportation information including bus stop location 52 and subway information 54 and 56 as well as well known building location indica 58 and 60 in order to make it easy for a person seeking to go to the addressor specific location 48. In the right bottom section of the back surface 4, bilingual information indicia is provided to include the addressor's name and address and communication information. It is to be noted that the map A does not extend into the calling card 26.

FIG. 3

Figure 3:
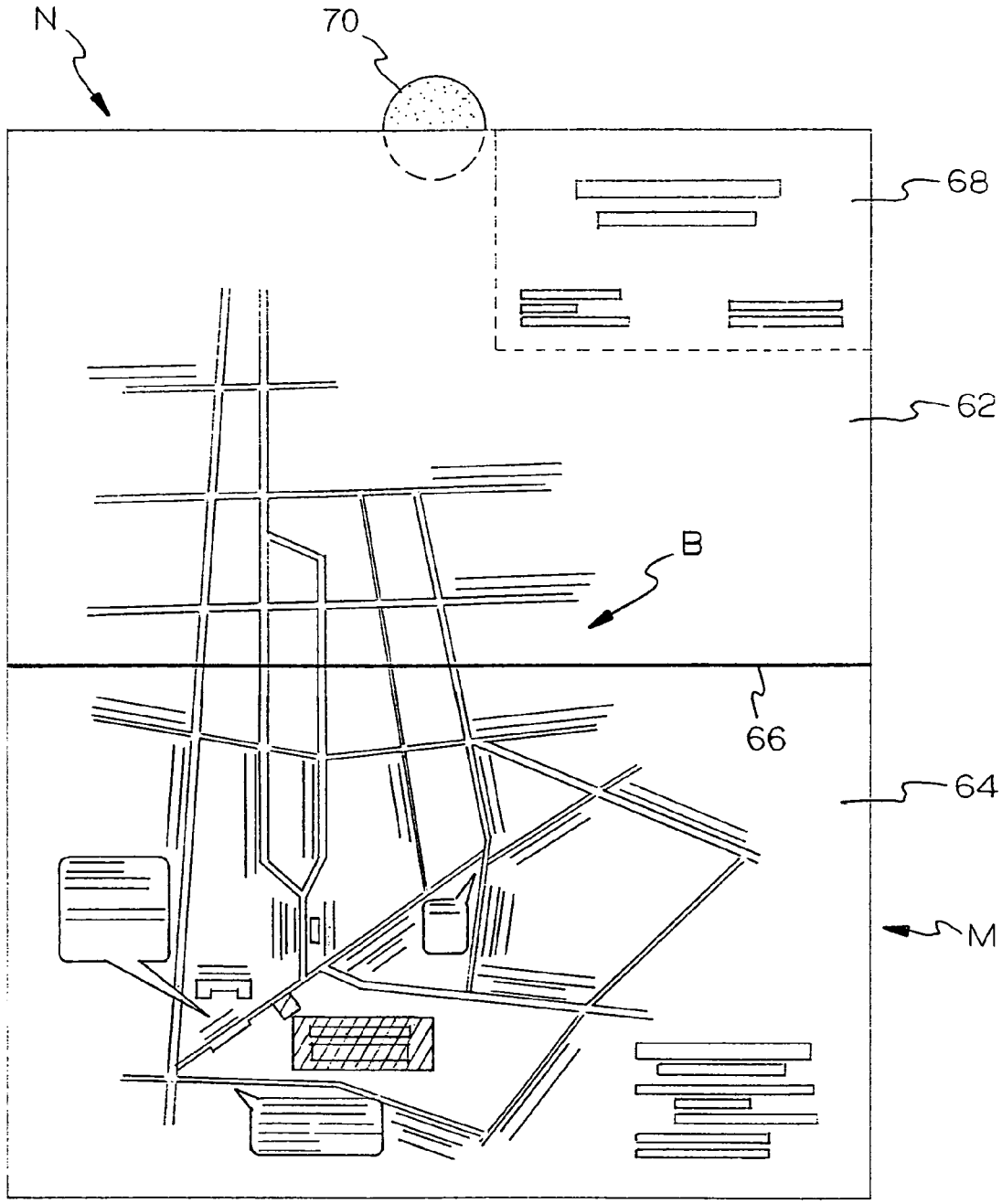
FIG. 3 is a top plan view of a modified version of the invention showing the attachment of a second panel to the back of a panel in which the front panel is similar to that of FIG. 1 and the front of the second panel is plain for reception of any indicia as may be desired and further showing portions in phantom and dotted lines.

In FIG. 3, you will note a modification N of the postcard P of FIG. 1. The modification N includes a first panel 62 and a second panel 64. The second panel 64 is attached to the first panel 62 by a fold line 66 which may be perforated for separating the first panel 62 from the second panel 64 as desired. The information indicia on the modification N includes a locator map B which may extend from panel 62 to panel 64. The locator map B has the same information thereon in the same manner as the locator map M of FIG. 2. The map information indicia does not extend into the calling card 68 which contains the same information front and back as disclosed in FIGS. 1 and 2. The front surface of the panel 62 is identical with the front surface of panel 2 shown in FIG. 1. The front of panel 64 may have indicia or may be plain as desired.

When the panel 62 and 64 are folded and overlie each over, a glue fastener or the like 70. is provided to hold the two panels together for mailing purposes.

The stiffness of the mailer M is substantially the same as a normal calling card.

While this invention has been described as having a preferred design, it is understood that it is capable of further modifications, and uses and/or adaptations of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A postal mailer including a removable calling card comprising:

a) post card having a panel having front and back surfaces each having left top, right top, left bottom, right bottom and central sections;

b) said post card having calling card stiffness;

c) said front surface right top section including a postage positioning area;

d) said front surface left to section being rectangular and including addressor name, addressor address and addresssor communication indicia;

e) said front surface central, left bottom and right bottom sections including forwarding address information;

f) said back surface right top section being rectangular and coextensive and cooperating with said front surface left top section to form said removable calling card;

g) said removable calling card having two connected outside edges and two connected inside perforated edges which when said preforated edges are broken, said removable calling card is detached from said front central and front right top sections and said back central and left top sections producing a removed calling card;

h) said back surface left top, left bottom, right bottom and central sections having a locator map having information including addressor, landmarks and street indicia;

i) said removable calling card being spaced from said locator map;

j) said post card is a bi-fold including a second panel;

k) said second panel in dimension corresponds and overlaps said first mentioned panel;

l) said second panel has front and back surfaces; and m) said front surface of said second panel includes a portion of said map indicia extending from said first mentioned panel.

2. A postal mailer as in claim 1, and wherein:

a) said second panel's back surface right top section includes return address indicia.

3. A postal mailer including a removable calling card as in claim 1, wherein:

a) said locator map addressor and landmarks indicia are easily observable from all other map information.

4. A postal mailer including a removable calling card as in claim 2, wherein:

a) said back surface includes second language indicia.

5. A postal mailer as in claim 2, and including:

a) means for separating said second panel from said first mentioned panel.

6. A postal mailer including a removable calling card as in claim 3, wherein:

a) said easily observable addressor indicia and landmarks indicia are of a different color from said street indicia.

* * * * *